US005346325A

United States Patent [19]

Yamanoi

[11] Patent Number: 5,346,325

[45] Date of Patent: Sep. 13, 1994

[54] PAPER HOLDER HAVING A LOCKING DEVICE

[76] Inventor: Seiichi Yamanoi, 1670-2, Oaza-Butai, Ina-machi, Tsukuba-gun, Ibaraki-ken, Japan

[21] Appl. No.: 94,992

[22] Filed: Jul. 23, 1993

[30] Foreign Application Priority Data

Jul. 24, 1992 [JP] Japan ..... 4-057716[U]

[51] Int. Cl.[5] ..... B42F 3/00

[52] U.S. Cl. ..... 402/38; 402/41

[58] Field of Search ..... 402/38, 39, 41

[56] References Cited

U.S. PATENT DOCUMENTS 2,178,546 11/1934 Trussell ..... 402/38
2,218,105 10/1940 Griffin ..... 402/38
3,098,490 7/1963 Wance ..... 402/38
5,135,323 8/1992 Pinheiro ..... 402/38

*Primary Examiner*—Mark Rosenbaum
*Assistant Examiner*—Willmon Fridie, Jr.
*Attorney, Agent, or Firm*—Armstrong, Westerman, Hattori, McLeland & Naughton

[57] ABSTRACT

A paper holder having a locking device for preventing clipping fingers from incidental opening comprising a back resilient plate, a pair of main bodies having longitudinal inner sides joining rotatably to each other and longitudinal outer sides embracing both of longitudinal outer sides of the back plate and rotatable at the embraced outer sides as pivotal portions and a plurality pairs of arcuate clipping fingers planted on the main bodies and capable of closing and opening by the vertical movement of the main bodies and a locking mechanism disposed at the end of the main bodies, wherein the locking mechanism comprises a manipulation member and an actuation portion disposed at the back thereof, in which the actuation member has an upper member and a lower member that extend horizontally opposing to each other to define a gap therebetween capable of receiving and vertically seizing the surface and the rear face of the longitudinal joining ends of the main body, whereby the upper member of the manipulation member is brought into contact with and immovably retains the upward movement of the main bodies in a vertically erected state of the manipulation member.

8 Claims, 6 Drawing Sheets

PAPER HOLDER HAVING A LOCKING DEVICE

BACKGROUND OF THE INVENTION

1. Field of the Invention

The present invention concerns a paper holder having a locking device for preventing clipping fingers from incidental opening.

2. Description of the Prior Art

In a paper holder, arcuate clipping fingers that conduct closing movement to form a semi-circular shape are opened, typically, by turning a manipulation member disposed to a longitudinal end of the paper holder or by the action of inverting the warp of a main body on which the clipping fingers are planted. Anyway, the clipping finger can be closed or opened by applying a closing/opening operation as required.

Generally, a paper holder basically has such a constitution as capable of retaining each of the states of the clipping fingers, namely, an open state and a closed state once attained by an operation given to them till a next operation is applied in the opposite way.

Compression stresses exert on the main body having the clipping fingers planted thereon when both sides of the main body are seized between a back plate, and this produces warping force of deforming them into arcuate cross sectional shapes. This results in bistable forms opposite to each other, that is, either an convex or concave shape.

In most of paper holders in the prior art, when it is intended to close the clipping fingers into a semi-circular shape, paired clipping fingers are closed to join the top ends of them by externally urging the outer circumferential ends of them.

However, even when the clipping fingers are once put into the closed state, they are sometimes caused to open spontaneously by external pressure, impact shock or the like, thereby detaching engaged sheets of paper out of the clipping fingers to trouble a user. This incidental or unwilling opening of the clipping fingers are often caused in the course of marketing communication before goods are handed to end users.

As an example, such troubles occur most frequently at the inside of a packaging case containing a plurality of paper holders, in particular, during transportation of them with the page-opening side of the paper holders being turned downward.

The size of sheets of paper engaged in a paper holder is generally smaller than that of a paper holder cover and all the weight of the engaged sheets of paper are supported only by the holder cover on both outer sides when the paper holder turned downward.

If packaged paper holders are fallen even from a slight height, weight of the engaged sheets of paper is exerted all together on the clipping fingers by the shock upon collision, which makes the clipping fingers open and all the engaged sheets of paper are detached from the paper holder.

Once after the sheets of paper have been detached, they are scattered at a time when the paper holders are taken out of the package, to worsen their commercial value.

SUMMARY AND OBJECT OF THE INVENTION

In view of the above, it is an object of the present invention to provide a paper holder having a opening/closing mechanism for clipping fingers, as well as a locking device capable of preventing clipping fingers from opening incidentally even when external impact shock should happen to exert on the clipping fingers, unless a predetermined unlocking operation is applied to the locking device.

The foregoing object can be attained according to the present invention by a paper holder having a locking device for preventing clipping fingers from incidental opening comprising:

a back plate made of a resilient material, a pair of main bodies having longitudinal inner sides joining rotatably to each other and longitudinal outer sides embracing both of longitudinal outer sides of the back plates and rotatable at the embraced outer sides as pivotal portions and a plurality pairs of rcuate clipping fingers planted in a row at the upper surface of the main bodies along the longitudinal direction thereof, in which the top ends of each pair of the clipping fingers are capable of engaging or disengaging with each other by the vertical movement off the joining inner sides of the main bodies and a locking mechanism rotatably engaged at one end of the main bodies, wherein the locking mechanism comprises a vertical manipulation member and an actuation portion disposed at the back of the manipulation member, in which the actuation member has an upper member which is to be in contact with the upper surface of an engaging portion on both corners of the joining inner sides at the longitudinal end of the main bodies and a lower member which is to be in contact with a lower surface of the engaging portion upon manipulation, and in which the upper member and the lower member extend horizontally opposing to each other to define a gap therebetween which is greater than the thickness of the engaging portion, whereby the upper member of the manipulation member is brought, into contact with and immovably retains the upward movement of the main bodies in a vertically erected state of the manipulation member.

In a preferred embodiment according to the present invention, both corners of the joining inner sides at the end of the main bodies are cut off to define a recess and slits extended from both lateral ends of the recess, such that the upper member and the lower member of the actuation portion of the locking mechanism are received in the recess and oppose to each other by way of the surface and the rear face of the engaging portion and both sides of the actuation portion are inserted and engaged in the slits.

In another preferred embodiment according to the present invention, the manipulation member has pivotal recesses formed on both sides in a lower portion thereof such that the inner sides at the longitudinal end of the main bodies spaced apart by the recess can be pivotally supported on both of the pivotal recesses.

In a further preferred embodiment according to the present invention, retaining portions are disposed in contiguous with the pivotal recesses formed on both sides in the lower portion of the manipulation member for restricting the main bodies from rotation exceeding a predetermined upper rotational limit.

In a further preferred embodiment according to the present invention, pivotal recesses having retaining sides each of the same lateral width as that of the longitudinal top end of the main body are disposed in contiguous with the pivotal recesses formed on both sides in the lower portion of the manipulation member for restricting the top ends from rotation exceeding a predetermined upper rotational limit position.

In a further preferred embodiment according to the present invention, latching protrusions are raised at the back of the manipulation member for restricting the longitudinal top ends of the main bodies from rotation exceeding a predetermined upper rotational limit.

In a further preferred embodiment according to the present invention, the locking mechanism comprises a vertical manipulation member and a horizontal actuation portion integrally joined at the base end thereof with the lower end at the back of the manipulation member, the bottom of the lower member of the actuation portion is brought into an intimate contact with the inner surface of the back plate and the lower surface of the upper member of the actuation portion is brought into an intimate contact with the surface of the engaging portion while being received in a recess 12 defined by cutting off both corners of the joining longitudinal ends of the main bodies in a state where the top ends of the clipping fingers are joined to each other, a fulcrum portion is defined at an intermediate portion between the bottom end of the gap and the back of the manipulation member, fulcrum shafts are raised on both sides of the actuation portion above the intermediate position and engaged to pivotal recesses 22 formed at predetermined positions at the longitudinal end of the main bodies, and a lug extends from the fulcrum portion at the bottom of the actuation portion with a gap being formed between the lug and the lower surface of the manipulation member.

In a further preferred embodiment according to the present invention, main body seizing members having the same inner size as the joining lateral size of the main bodies upon closure of the clipping fingers are protruded in the lower portion of the manipulation member at a height of the upper surface of the main bodies in flush with the extended surface of the actuation portion.

In a further preferred embodiment according to the present invention, retaining fingers protrude from the upper surface on the outer corners at the longitudinal end of the main bodies, while retaining ridges are formed along the edges at the back of the manipulation member such that the retaining fingers of the main bodies can be resiliently seized on the outsides thereof with the retaining ridges at the back of the manipulation member.

The paper holder is adapted to open and close the top ends of the clipping fingers, and operates depending on the opening or closing manipulation. It is intended in the present invention to prevent the clipping fingers once put into a closed state from incidentally or accidentally opening.

A paper holder usually has an opening/closing mechanism for clipping fingers. The locking device for preventing the clipping fingers from incidental opening provided in the present invention may also serve as such an opening/closing mechanism.

The locking device for preventing incidental opening (hereinafter simply referred to as a locking mechanism) is disposed at a longitudinal end of a paper holder and it is usually in a vertically erected state when a plurality pairs of clipping fingers are closed and, unless the locking mechanism is unlocked, the clipping fingers can not open even when opening force is exerted by the manipulation of the opening/closing member or by incidental impact shocks applied from the outside of the paper holder.

In the locking mechanism of the present invention, the mechanism keeps locking action as far as it erects vertically and the locking action is released by turning down the locking mechanism rotationally toward the longitudinal extension of the paper holder main body.

The paper holder according to the present invention comprises paired main bodies each having a plurality of clipping fingers planted on the upper surface thereof. Mating fingers constituting a pair are disposed on the two main bodies respectively, and a plurality of such pairs are arranged in a row along the longitudinal direction of the main bodies. Each pair of the clipping fingers can join at the center to form an arcuate shape and can detach rightward and leftward from each other.

The paired main bodies are so adapted that they integrally join at the longitudinal inner sides and the joining sides can move vertically at each of the outer sides as a center of rotation, for closing or opening the arcuate ring of the clipping fingers. When the joining sides situate below a line connecting the both outer sides, the top ends of all the clipping fingers join to form rings. In this state, sheets of paper can be bundled in the paper holder.

On the other hand, when the joining sides situate above the connection line, the top ends of all the clipping fingers disengage from each other. In this state, the sheets of paper can be engaged, detached or replaced.

When an external force is applied so as to narrow the horizontal width of the line, joining sides of both of the main bodies, they can take and maintain either one of bistable states, i.e., they are situated slightly below or above the connection line. The back plate is made of a resilient steel plate and used to apply such an external force.

If both of the clipping fingers and the main bodies are made of steel, the back plate lies above the main bodies so as to cover them, whereas the back plate lies below the main bodies if the clipping fingers and the main bodies are made of a synthetic resin.

The resilient action of the back plate is substantially identical irrespective that it situates above or below the main body. It is determined mainly with an aim of facilitating the manufacturing or assembling operation, as well as an esthetic appearance as commercial articles.

In a case where the main body and the clipping fingers are made of steel, the back plate is situated above the main bodies and has through holes for clipping fingers formed on one side and recessed sloes for clipping fingers formed on the other side. The side having the through holes has a retaining portion for receiving the side edge of the main body while the other side having the recessed slots has as a pivotally support portion for surrounding the side edge of the main body. The two main bodies joining with each other can be held by the retaining portion and the pivotally support portion in a stable state by the resilient action of the back plate such that the joining sides situate either at a higher or lower position.

In a case where the main bodies and the clipping fingers are made of a synthetic resin, the main bodies join at their longitudinal inner sides and embrace, at their outer sides, both outer sides of a back plate made of a resilient plate and having a width smaller than the entire joining width of the main bodies, such that the respective main bodies can rotate vertically at the embraced outer sides as the fulcrum portion.

In this case, transition from one to another states of the main bodies is given by the resiliency of the back plate. The back plate in one of warped shapes is made flat forcively while accumulating compression energy therein and then rapidly snaps resiliently into an opposite warped shape while releasing this accumulated energy.

In a state where the top ends of the clipping fingers are closed, the joining sides of the main bodies provide their function at a position lower than the line connecting the fulcrum portions on both sides thereof. On the other hand, when the top ends of the clipping fingers are opened, the main bodies provide their function at a position higher than the line connecting the fulcrum portions.

Since an incidental or unwilling opening of the clipping fingers is caused when an external force that overcomes the resiliency of the back plate exerts on the clipping fingers, the locking action for the fingers can be kept if the joining sides of the main body is retained at a lower position.

As has been described above in accordance with the present invention, the locking action can be attained by vertically erecting the locking (manipulation) member and an unlocking action can be attained by turning down the locking member.

The locking mechanism has an L-shaped basic structure comprising a vertical manipulation member and a horizontal actuation portion, which operates in a lever-like system having a fulcrum on or near the lower bent portion. The actuation portion is disposed at the back of the manipulation member, that is, on the side opposite to the turning direction thereof. The actuation portion has an upper member and a lower member opposed to each other at a gap into which the joining sides of the two main bodies are inserted and engaged, so that the upper member and the lower member move vertically by the rotation of the manipulation member thereby causing to vertically move the position of the joining sides of the main bodies put between the upper and the lower members. On the other hand, the locking action can be provided by inhibiting the manipulation member from rotation and keeping the member in a vertically erected state.

In a case where the clipping fingers are in an open state and when attachment or detachment of sheets of paper to be clipped has been completed, if the clipping fingers are brought into the closed state, the locking action is applied automatically and simultaneously with the closing action for the clipping fingers. However, the clipping fingers can not be opened by any incidental shock or by mere opening manipulation unless unlocking manipulation is applied to the locking mechanism.

As has been described above, manipulation for opening the closed clipping fingers is conducted by a series of procedures of releasing the locking mechanism and then opening the clipping fingers. Even in a paper holder in which an opening/closing member for the clipping fingers is disposed in addition to the locking mechanism, the clipping fingers can not be opened unless the manipulation is applied in the sequence of the above-mentioned procedures. Further, in a case where no opening/closing member is disposed, and the locking mechanism acts also as the opening/closing member, the manipulation sequence is the same as described above.

As described above, when the clipping fingers are in the closed state, the manipulation member of the locking mechanism is erected vertically. Then, if the manipulation member is rotationally turned outward, the locked state is released. Then, when the turning manipulation is continued to the manipulation member to turn it further downward, the clipping fingers can be opened.

Accordingly, since the two steps of manipulation procedures are made continuously in one direction, unlocking for the locking mechanism and the opening for the clipping fingers are conducted by one-touch operation. The action conducted to the locking mechanism of the present invention is applied in two steps, in which the action in the first step does not arise spontaneously but is caused only by predetermined manual operation, so that incidental opening can be prevented.

BRIEF DESCRIPTION OF THE DRAWINGS

These and other objects, constitutions, as well as advantageous features of the present invention will become more apparent by reading the following descriptions for preferred embodiments with reference to the accompanying drawings, wherein.

DESCRIPTION OF THE PREFERRED EMBODIMENTS

Figure 1:
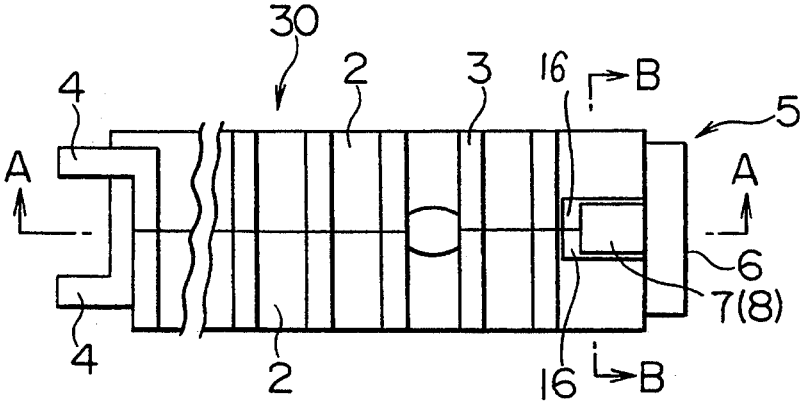
FIG. 1 is a plan view for a portion of a paper holder in one embodiment according to the present invention.
Figure 2:
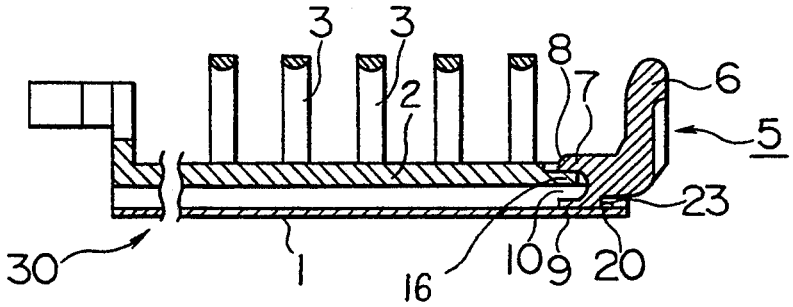
FIG. 2 is a vertical cross sectional view taken along line A-A in FIG. 1.
Figure 3:
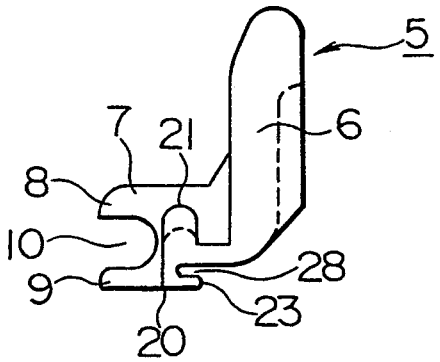
FIG. 3 is a side elevational view of a locking mechanism in a preferred embodiment according to the present invention.
Figure 4:
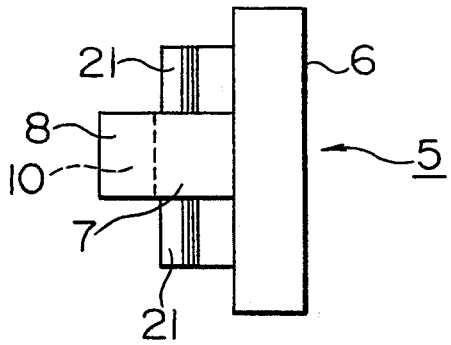
FIG. 4 is a plan view for the locking mechanism.
Figure 5:
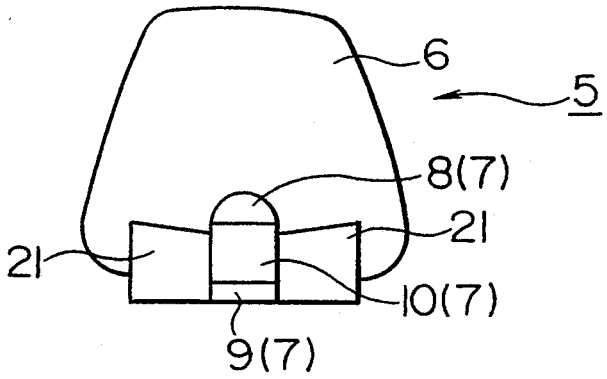
FIG. 5 is a front elevational view for the inside of the locking mechanism.
Figure 7:
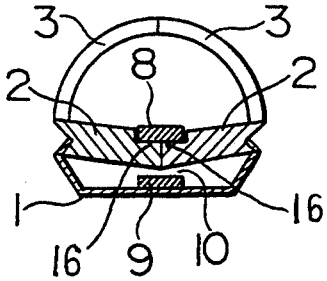
FIG. 7 is a cross sectional view taken along line B-B in FIG. 1.

Description will now be made to preferred embodiments of the present invention with reference to FIG. 1 through FIG. 19 of the drawings. As shown in FIGS. 1 and 2, a paper holder comprises a back plate 1 made of a resilient material and having a predetermined width between both of side edges and main bodies 2, 2 having an entire width slightly greater than the width of the back plate 1 and engaging the inside of both outer side edges of the back plate 1. A plurality pair of clipping fingers 3 each having an arcuate shape in the lateral cross section are planted on the upper surface of the paired main bodies 2, 2 such that the opposing top ends of each pair are engaged and disengaged with each other. The paired main bodies 2, 2 join with each other at their longitudinal inner sides and embrace at their outer sides the outer sides of both side edges of the back plate 1 (refer to FIG. 7). They are attached to the inside of a paper holder body 30.

The principal portion of the paper holder is made of a metal or synthetic resin material.

In an embodiment of a paper holder made of metal, the main bodies, 2, 2 and the back plate 1 are made of steel plates, and the clipping fingers 3 are made of a steel wire or from the same steel plate as that used for the main body.

In an embodiment of a paper holder made of a resin, only the back plate 1 is made of a steel plate, and the clipping fingers 3 and the main body 2 are integrally molded from a synthetic resin.

In either of the metal paper holder or the resin paper holder, the locking mechanism 5 of the present invention is disposed to each of longitudinal ends or, optionally, the locking mechanism 5 is disposed to one longitudinal end while a usual opening/closure member 4 is disposed to the other end (for example, refer to FIG. 1, 2).

The paired main bodies 2, 2 have a plurality pair of arcuate clipping fingers 3 disposed in a row on the upper surface thereof and rotatably join to each other along their longitudinal inner sides. The main bodies 2, 2 embrace, at their respective outer sides, both outer sides of the back plate 1 made of a steel plate and are pivotally supported along both outer sides of the plate 1, so that the top ends of the clipping fingers 3, 3 are closed or opened with each other by vertical movement of the joining inner sides of the two main bodies 2, 2.

A locking mechanism 5 comprises a vertical manipulation member 6 and a horizontal actuation portion 7 disposed at the back of the manipulation member 6. The actuation portion 7 has an upper member 8 which is to be in contact with the upper surface of an engaging portion 16 on both corners at the longitudinal end of the joining inner sides off the main bodies 2, 2 and a lower member 9 which is to be in contact with the lower surface of the engaging portion 16 upon manipulation.

The upper member 8 and the lower member 9 extend horizontally opposing to each other at a vertical gap 10 which is greater than the thickness of the engaging portion 16, so that the main bodies 2, 2 can be inhibited from upward movement by the upper member 8 in a state where the manipulation member 6 is vertically erected.

Figure 12:
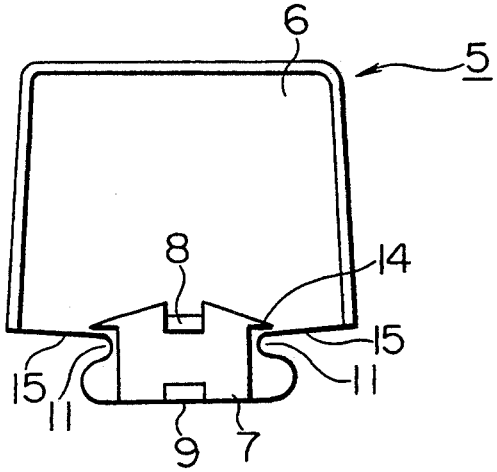
FIG. 12 is a back elevational view of FIG. 11.
Figure 18:
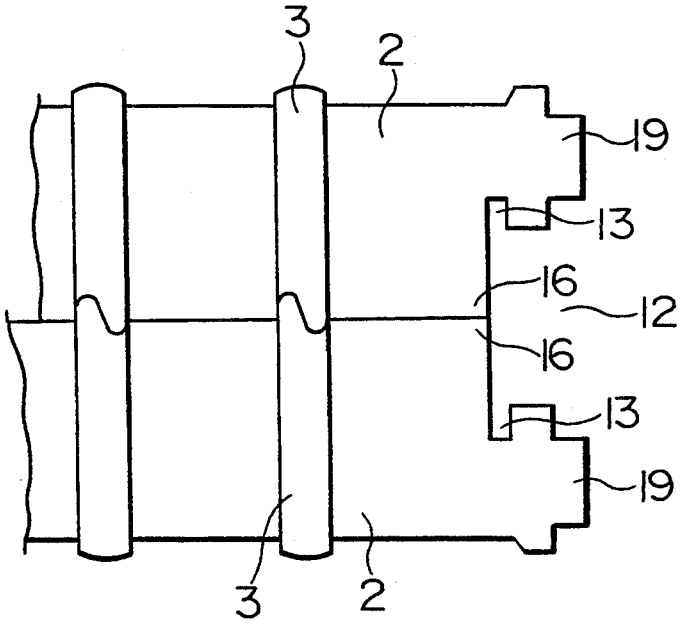
FIG. 18 is an enlarged plan view for the longitudinal end of main bodies in a further embodiment.

Both corners of the inner joining sides at the longitudinal end of the main bodies 2, 2 are cut off to define a recess 12 and slits 13 extending rightward and leftward from both lateral sides of the recess 12, so that the upper member 8 and the lower member 9 of the actuation portion 7 of the locking mechanism 7 are opposed by way of the surface and the rear face of the engaging portion 16 while being received in the recess 12 (refer to FIG. 18). A stopper 14 longer than the slit 13 is protruded from each of the sides at the top end of the actuation portion 7 (refer to FIG. 12).

Figure 13:
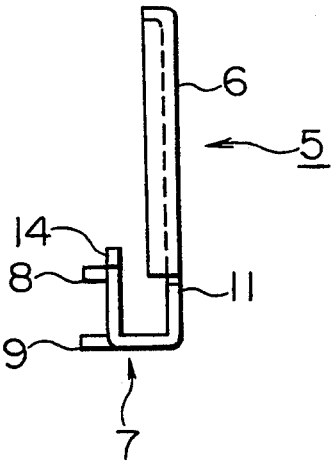
FIG. 13 is a side elevational view of FIG. 11.

Further, pivotal recesses 11 are formed on both sides in a lower portion of the manipulation member 6 such that the inner sides of top ends 19, 19 formed at the longitudinal end of the main bodies 2, 2 spaced apart by the recess 12 can be pivotally supported by the pivotal recesses 11. Retaining portions 15 are formed in contiguous with the pivotal recesses 11 for restricting the main bodies 2, 2 from rotation exceeding a predetermined upper rotational limit (refer to FIGS. 12 to 14).

Figure 14:
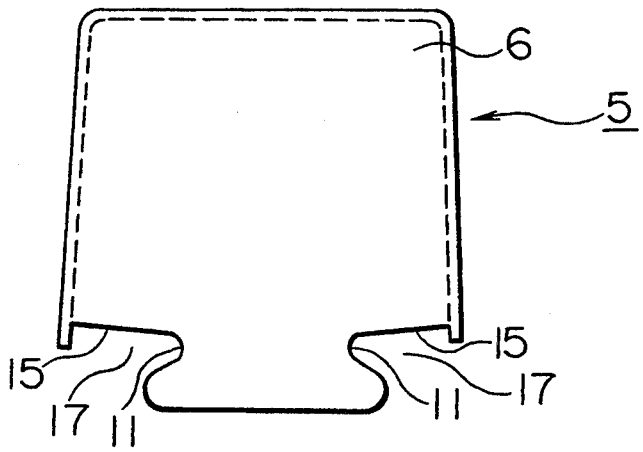
FIG. 14 is a front elevational view of a locking mechanism in a further embodiment.

Further, pivotal recesses 17 each having a retaining portion 15 at a width of the top end 19 of the main bodies 2, 2 may be formed in contiguous with the pivotal recesses 11 for restricting the top ends 19 from rotation exceeding a predetermined upper rotational limit (refer to FIG. 14).

Figure 15:
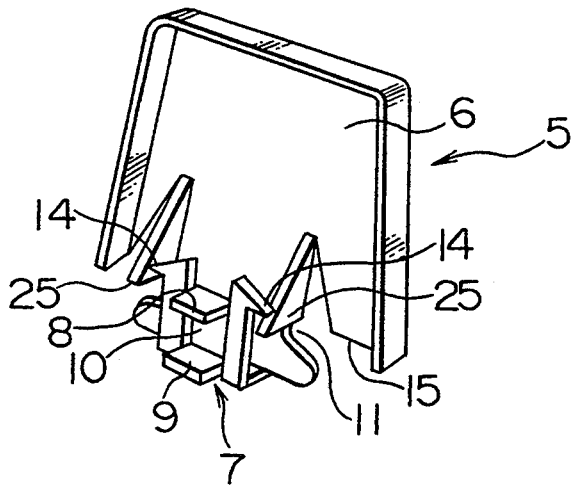
FIG. 15 is a perspective view at the back of a locking mechanism in a further embodiment.
Figure 16:
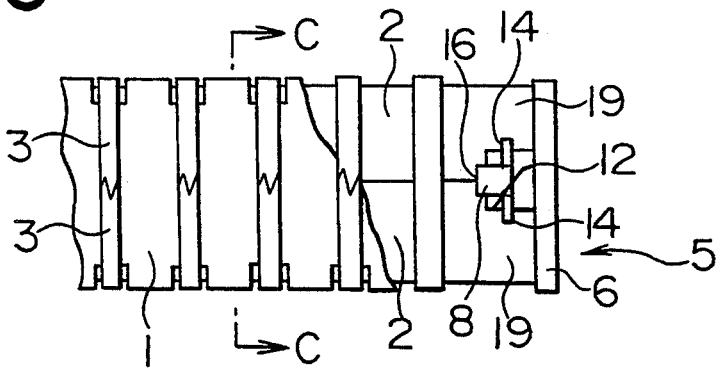
FIG. 16 is a plan view for a portion of a metal paper holder with a back plate being partially depleted.
Figure 17:
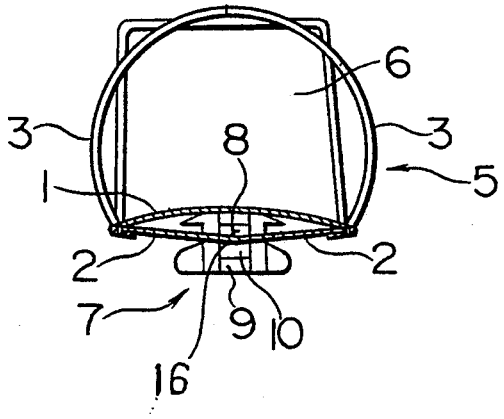
FIG. 17 is a cross sectional view taken along line C-C in FIG. 16.

Further, latching protrusions 25 are raised at the back of the manipulation member 6 for restricting the top ends 19, 19 of the main bodies 2, 2 from rotation exceeding a predetermined upper rotational limit (refer to FIG. 15).

In this embodiment as described above, the main bodies 2, 2 having the clipping fingers 3, the locking mechanism 5, as well as the back plate 1 are made of metal material. In this case, the back plate 1 covers the upper surface of the main bodies 2, 2.

In a case where the main bodies 2, 2 including the clipping fingers 3 are made of a synthetic resin as described just below, the back plate 1 is mounted below the main bodies 2, 2 and it can not be seen from above (refer to FIG. 2)

The locking mechanism 5 is interposed into the gap between each of the top ends 19, 19 spaced apart laterally by the recess 12 at the longitudinal end of the main bodies 2, 2. The inner sides of the top ends 19, 19 engage the pivotal recesses 11 which are formed in the lower portion of the manipulation member 6 and which function as the fulcrum, and the upper surface of the top ends are abutted against the retaining portion 15.

Further, both sides of the actuation portion 7 disposed at the back of the manipulation member 6 engage the slits 13, 13 in contiguous with the recess 12 formed at the end of the main bodies 2, 2, so that they guide the vertical rotation of the actuation portion 7 caused by the rotational manipulation applied to the manipulation member 6.

Further, the stoppers 14, 14 disposed on both sides at the upper end of the actuation portion 7 protrude through the end of the slits 13. Accordingly, in a state where the manipulation member 6 is vertically erected, the stoppers 14, 14 engage the upper surface of the top ends 19, 19 of the main bodies 2, 2 thereby maintaining the vertically erected state of the manipulation member 6.

The main bodies 2, 2 are secured at the longitudinal joining sides to a paper holder cover. Since the pivotal recesses 11 in the manipulation member 6 pivotally engaging the insides of the top ends 19, 19 are spaced apart each by a certain distance from the joining sides, the manipulation member 6 has a so-called movable fulcrum and rotates while being supported on the movable fulcrum.

In a state where the top ends of the mating fingers 3, 3 join to each other, namely, in a closed state of the main bodies 2, 2, they take a concave shape with the joining sides being at a lowermost portion, which is to be maintained unless they are opened intentionally.

When the manipulation member 6 of the locking mechanism 5 is vertically erected relative to the longitudinal direction of the main bodies 2, 2, the lower surface of the upper member 8 of the actuation portion 7 disposed at the back of the manipulation member 6 keeps the top ends of the mating clipping fingers 3, 3 of the main bodies 2, 2 joined to each other. Accordingly, if the upper member 6 is in contact with the upper surface of the engaging portion 16 of the closed main bodies 2, 2 and, further, the latching protrusions 25 are disposed at the back of the manipulation member 6, the latching protrusions 25 press the top ends 19 of the main bodies 2, 2 thereby preventing incidental rising of the engaging portion 16, that is, incidental opening of the fingers and continuing the locking action.

As other locking action, the upper surface of the top ends 19, 19 in the main bodies 2, 2 is retained by the retaining portions 15 in contiguous with the pivotal recesses 11 formed in the lower portion of the manipulation member 6, so that the main bodies 2, 2 are kept in a concaved closed state and prevented from incidental opening.

Further, in a ease where the pivotal recesses 17 have retaining portions 15 of such a width as capable of engaging the entire width of the top ends 19, 19, the joining inner sides of the main bodies 2, 2 can not when the top ends of the clipping fingers 3, 3 detach from each other into an open state rise unless the lateral width off the main bodies 2, 2 is slightly enlarged. Accordingly, rotation of the top ends 19, 19 are restricted by the pivotal recesses 17 each having the retaining portion 15.

If it is intended to release the locking action For the main bodies 2, 2 restricted from rotational movement by the vertical erection of the manipulation member 6, the vertically erected manipulation member 6 is turned outward.

In this instance, the locking mechanism 5 rotates at the insides of the top ends 19, 19 of the main bodies 2, 2 in engagement with the pivotal recesses 11 in the lower portion of the manipulation member 6, as the fulcrum, in accordance with the unlocking manipulation.

The locking action restricting the operation of the main bodies 2, 2 are released by way of all the rotation preventive means in contact with the main bodies 2, 2 by the rotation of the manipulation member 6. If the rotational manipulation to the manipulation member 6 is further continued, the upper surface of the lower member 9 in the actuation portion 7 abuts against the lower surface of the engaging portion 16, which causes a further rising operation to transfer the concave shape of the back plate 1 into a convex shape against an inherent resiliency thereof to guide the clipping fingers 3 into an open state.

Description will then be made to a further embodiment in which clipping fingers 3, 3 and main bodies 2, 2 having clipping fingers 3, 3 formed integrally therewith are made of a synthetic resin except for the back plate 1. As described above, in the resin paper holder, the back plate 1 is mounted below the main bodies 2, 2. However, this resin paper holder is substantially the same as the metal paper holder, regarding the pivotal action and the utilization of resiliency of the back plate 1, and joining off the two main bodies 2, 2 along the longitudinal sides, the convex or concave shape, as well as the effects obtained therefrom.

In addition, constitution and the effect of the locking mechanism 5 mounted to the longitudinal end of the main bodies 2, 2 are basically identical, excepting that the thickness of the material, being synthetic resin, may be made greater than that of the metal plate, and the rotational fulcrum of the locking mechanism 5 can be set in the back plate 1 since the plate is attached below.

Both of the clipping fingers 3, 8 and the main bodies 2, 2 are made of a synthetic resin material by integral molding. A locking mechanism is also formed integrally and comprises a vertical manipulation member 6 and a horizontal actuation portion 7 in contiguous at the base end thereof with the lower end at the back of the manipulation member 6.

The actuation portion 7 comprises an upper member 8 and a lower member 9 that extend horizontally opposing to each other at a vertical gap 10. The gap 10 has a size greater than the thickness of the engaging portion 16 on both of the corners in the joined sides at the longitudinal end of the main bodies 2, 2 such that the engaging portion 16 can be inserted into the gap 10.

In this embodiment, the lower surface of the upper member 8 is to be in an intimate contact with the surface of the engaging portion 16 while being received in the recess 12 defined by recessing both corners of the joining sides at the longitudinal end of the main bodies 2, 2 and the bottom of the lower member 9 is to be in an intimate contact with the inner surface of the back plate 1 when the top ends of the clipping fingers 3 are in the closed state.

A fulcrum portion 20 is defined at an intermediate position between the bottom end of the gap 10 and the back of the manipulation member 6, and fulcrum shafts 21 are raised on both sides of the actuation portion 7 above the intermediate position, which are engaged and joined with the pivoted recesses 22 formed at predetermined positions of the main bodies 2, 2.

Figure 8:
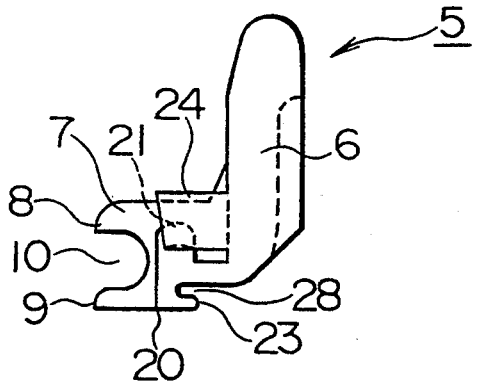
FIG. 8 is a side elevational view of a locking mechanism in a further embodiment of the present invention, in which main body seizing members are disposed on both sides of a lower end of a manipulation member.
Figure 9:
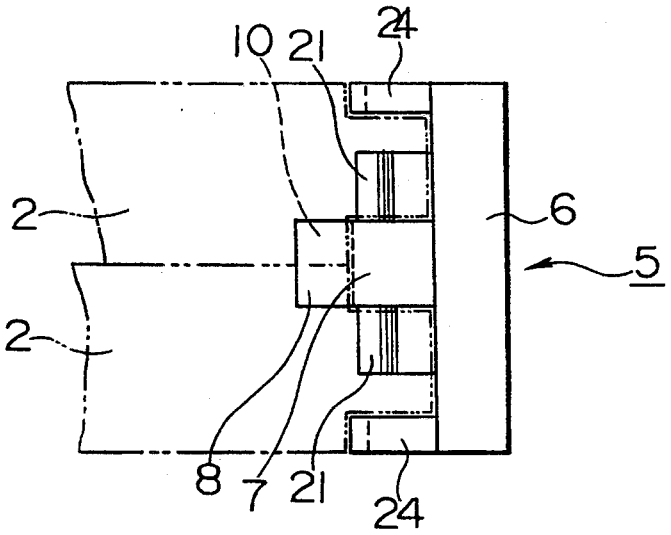
FIG. 9 is a plan view of the locking mechanism in which main body seizing members are disposed on both sides of a lower end of a manipulation member.

Further, a tongue 23 extends from the Fulcrum portion 20 at the bottom of the actuation portion 7 and a gap is formed between the tongue 23 and the lower surface of the manipulation member 6 (refer to FIGS. 8 and 9).

In a further embodiment, a locking mechanism 5 is integrally formed and comprises a vertical manipulation member 6 and a horizontal actuation portion 7 in contiguous at the base end thereof with the back of the manipulation member 6.

The actuation portion 7 has an upper member 8 and a lower member 9 extend horizontally and oppose to each other at a vertical gap 10 greater than the thickness of the engaging portion 16 on both corners of the joined sides at the longitudinal end of the main bodies 2, 2, so that the engaging portion 16 can be inserted into the gap 10.

In a closed state in which-the top ends of the clipping fingers 3, 3 of the main bodies 2, 2 are joined with each other, the lower surface of the upper member 8 is to be in an intimate contact with the surface of the engaging portion 16 while being received in the recess 12 formed by cutting off both corners of the joining sides at the longitudinal end of the main bodies 2, 2 and the bottom of the lower member 9 is to be in an intimate contact with the inner surface of the back plate 1.

Further, a fulcrum portion 20 is defined at an intermediate portion between the bottom end of the gap 10 and the back of the manipulation member 6, and fulcrum shafts 2, 2 are raised on both sides of the actuation portion 7 above the intermediate position, which are engaged and joined with the pivotal recesses 22 formed to predetermined positions at the longitudinal ends of the main bodies 2, 2.

Further, a tongue 23 extends from the fulcrum portion 20 at the bottom of the actuation portion 7 and a gap is formed between the tongue 23 and the manipulation member 6.

Main body seizing members 24, 24 having the same inner size as that of the entire lateral size of the main bodies 2, 2 upon closure of the clipping fingers 3, 3 are protruded at a height of the upper surface of the main bodies 2, 2 in the lower end of the actuation portion 7 in flush with the extending surface of-the actuation portion 7 (refer to FIGS. 8, 9).

Figure 10:
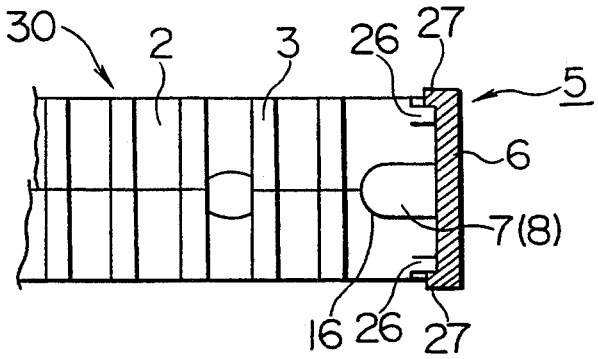
FIG. 10 is a plan view of a locking mechanism in a further embodiment showing a manipulation member in cross section in which retaining edges are disposed on both sides of a lower end of a manipulation member.
Figure 11:
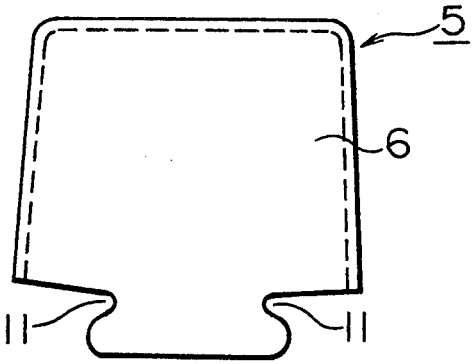
FIG. 11 is a front elevational view of a locking mechanism in a further embodiment.
Figure 19:
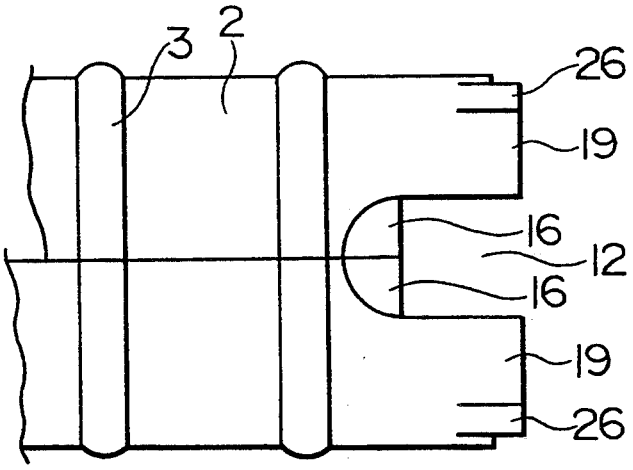
FIG. 19 is an enlarged plan view for the longitudinal end of main bodies in a further embodiment.

Further, retaining fingers 26, 26 protrude from the upper surface on the outer corners at the longitudinal end of the main bodies 2, 2, and retaining edges 27. 27 protrude from the edge at the back of the manipulation member 6 so that the retaining fingers 26, 26 of the main bodies 2, 2 can be seized from the outer sides thereof when the manipulation member 6 of the locking mechanism 5 is erected vertically in a closed state where the top ends of the clipping fingers 3, 3 join with each other (refer to FIGS. 10, 19).

The opening/closure member 4 is disposed to at least one end of the main bodies 2, 2, and the locking mechanism 5 is attached to the other end of the main bodies 2, 2. The locking mechanism 5 comprises a one-piece member substantially in an L-shaped cross-sectional configuration having a vertical manipulation member 6 and a horizontal actuation portion 7 disposed at the back of the manipulation member 6.

The actuation portion 7 protruding horizontally at the lateral center from the lower end of the manipulation member 6 has an upper member 8 and a lower member 9 at the top end thereof to define a U-shaped vertical gap 10 therebetween.

The height of the gap 10 is made as large as about twice of the thickness of the engaging portion of the main bodies 2, 2 to be engaged.

Then, at the instance where the main bodies 2, 2 are engaged to the gap 10, it is important that the inner surface of the back plate 1 is in an intimate contact with the bottom of the actuation portion 7 during closure of the clipping fingers 3, 3 in the main bodies 2, 2.

Figure 6:
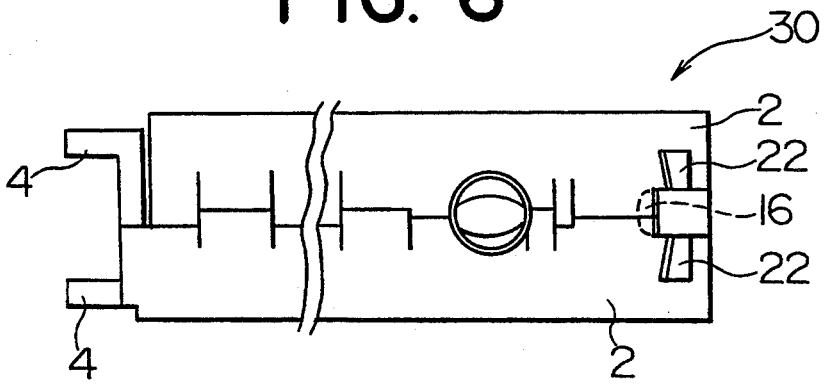
FIG. 6 is a bottom plan view of a principal portion of a paper holder main body.

A fulcrum portion 20 is defined in the bottom at the intermediate position between the bottom end of the gap 10 and the back of the manipulation 6, and fulcrum shafts 21, 21 each having a semi-circular upper portion protrude from the upper surface on both sides of the actuation portion 7, and semi-circular grooves capable of engaging the fulcrum shafts 21 are recessed to corresponding positions at the lower surface of the main bodies 2, 2 to form pivotal recesses 22, to thereby define the fulcrum portion 20 substantially as the engaging portion for positioning in the main bodies 2, 2 (refer to FIG. 6).

Referring more specifically to the shape of the fulcrum shafts 21, tops of the fulcrum shafts 21, 21 on both sides of the actuation portion 7 are sloped down toward the center and raise toward the outside obliquely. When the clipping fingers 3, 3 are in a closed state, the bottom of the two main bodies 2, 2 define a concave slope with the joining portion being at the lowermost position, and the tops of the fulcrum shafts 21 are inclined conforming with the slopes, in order that the area of contact between the fulcrum shafts 21 and the pivotal recesses 22 are increased to completely maintain the closed state of the clipping fingers 3, 3.

Further, the bottom of the actuation portion 7 extends in the form of a tongue 23 from the fulcrum portion 20 to a position below the manipulation member 6 and a gap is formed between the manipulation member 6 not brought into contact with the inner surface of the back plate i and the bottom of the fulcrum portions 20 upon closure of the clipping fingers 3, 3, so that the closed state as is maintained the locking mechanism utilizing the material resiliency of the tongue 23.

The engaging portion 16 of the main bodies 2, 2 abutted by the upper member 8 that forms a gap 10 in the actuation portion 7 may be formed as a thin walled portion stepped lower from the upper surface of the main bodies 2, 2.

Furthermore, main body seizing members 24, 24 having the same inner size as the entire lateral size of the main bodies 2, 2 upon closure of the clipping fingers 3. 3 protrude on both sides in the lower end of the actuation member 6 at a height opposing to the ends of the joining main bodies 2, 2 in flush with the extending surface of the actuation portion 7, such that they can seize both sides of the main bodies 2, 2 at the longitudinal end when the manipulation member 6 is erected vertically. In this embodiment, the main body seizing members 24. 24 and the retaining edges 27, 27 detach from both sides of the main bodies 2, 2 at the longitudinal end and the retaining fingers 26, 26 upon turning down of the manipulation member 6, so that the restriction on the lateral size can be released to allow a slight variation in the lateral size of the main bodies 2, 2 along with the opening of the clipping fingers 3, 3.

Furthermore, in order to make the outer width of the main body seizing members 24, 24 identical with the lateral size of the main bodies 2, 2, the size of the main bodies 2, 2, may optionally be reduced by recessing the engaging portions thereof in a case where the inner size of the main body seizing members 24, 24 is small.

As has been described above according to the present invention, the opening/closure mechanism will not be operated even if the clipping fingers are intended so be opened unless the unlocking manipulation is applied to the locking mechanism.

In addition, even if impact shocks should exert, thereby tending to cause an unintentional opening, such incidental opening can be prevented by the action of the locking mechanism.

What is claimed is:

1. A paper holder having a locking device for preventing clipping fingers from incidental opening comprising:

a back plate made of a resilient material, a pair of main bodies having longitudinal inner sides pivotally connected to each other and longitudinal outer sides embracing both of longitudinal outer sides of said back plate and rotatable at the embraced outer sides as pivotal portions and a plurality pairs of arcuate clipping fingers planted in a row at the upper surface of the said main bodies along the longitudinal direction thereof, in which the top end of each pair of the clipping fingers are capable of engaging or disengaging with each other by the vertical movement of the joining inner sides of said main bodies and a locking mechanism rotatably engaged at one end of said main bodies, wherein the locking mechanism comprises a vertical manipulation member and an actuation portion disposed at the back of said manipulation member, in which the actuation member has an upper member which is to be in contact with the upper surface of an engaging portion on both corners of the joining inner sides at the longitudinal end of said main bodies and a lower member which is to be contact with a lower surface of said engaging portion upon manipulation, and in which said upper member and said lower member extend horizontally opposing to each other to define a gap therebetween which is greater than the thickness of said engaging portion, whereby said upper member of the manipulation member is brought into contact with and immovably retains the upward movement of said main bodies in a vertically erected state of said manipulation member; and wherein retaining fingers protrude from the upper surface on the outer corners at the longitudinal end of the main bodies, while retaining ridges are formed along said edges at the back of the manipulation member such that the retaining fingers of said main bodies can be resiliently seized on the outsides thereof with said retaining ridges at the back of said manipulation member.

2. A paper holder as defined in claim 1, wherein both corners of the joining inner sides at the end of the main bodies are cut off to define a recess and slits extended from both lateral ends of said recess, such that the upper member and the lower member of the actuation portion of the locking mechanism are received in said recess and oppose to each other by way of the surface and the rear face of the engaging portion and both sides off said actuation portion are inserted and engaged in said slits.

3. A paper holder as defined in claim 1 or 2, wherein the manipulation member has pivotal recesses formed on both sides in a lower portion thereof such that the inner sides at the longitudinal end of the main bodies spaced apart by the recess can be pivotally supported on both of said pivotal recesses.

4. A paper holder as defined in claim 3, wherein retaining portions are disposed adjacent the pivotal recesses formed on both sides in the lower portion of the manipulation member for restricting the main bodies from rotation exceeding a predetermined upper rotational limit.

5. A paper holder as defined in claim 3, wherein pivotal recesses having retaining sides each of the same lateral width as that of the longitudinal top end of the main body are disposed in contiguous with the pivotal recesses formed on both sides in the lower portion of the manipulation member for restricting the top ends from rotation exceeding a predetermined upper rotational limit.

6. A paper holder as defined in claim 1 or 2 wherein latching protrusions are raised at the back of the manipulation member for restricting the longitudinal top end of the main bodies from rotation exceeding a predetermined upper rotational limit.

7. A paper holder as defined in claim 1, wherein the locking mechanism comprises a vertical manipulation member and a horizontal actuation portion integrally joined at the base end thereof with the lower end at the back of said manipulation member, the bottom of the lower member of said actuation portion is brought into an intimate contact with the inner surface of the back plate and the lower surface of the upper member of said actuation portion is brought into an intimate contact with the surface of the engaging portion while being received in a recess defined by cut-off corners of the joining longitudinal end of the main bodies in a state where the top ends of the clipping fingers are joined to each other, a fulcrum portion is defined at an intermediate portion between the bottom end of the gap and the back of said manipulation member, fulcrum shafts are raised on both sides of said actuation portion above said intermediate position and engaged to pivotal recesses formed at predetermined positions at the longitudinal end of said main bodies and a lug extends from said fulcrum portion at the bottom of said actuation portion with a gap being formed between said lug and the lower surface of said manipulation member.

8. A paper holder as defined in any one of claims 1, 2, 4, 5 or 7, wherein a pair of main body seizing members 24, 24 which protrude in parallel with the actuation portion 7 are formed integrally with both sides in a lower portion of the manipulation member 7, said main body seizing members 24, 24 define a gap therebetween which is identical with the lateral size of the main bodies 2, 2 upon closure of the clipping fingers 3, 3, and said main bodies 2, 2 are seized on both outsides at the top end thereof between said main body seizing members 24, 24 of the manipulation member 6 rotated to a vertically erected position.

* * * * *